US008698051B2

(12) United States Patent
Twiney et al.

(10) Patent No.: US 8,698,051 B2
(45) Date of Patent: Apr. 15, 2014

(54) HEATING SYSTEM, HEATER, AND METHODS OF HEATING A COMPONENT

(75) Inventors: Robert Christopher Twiney, Fivehead (GB); Christopher Martin Morter, Culmstock (GB)

(73) Assignee: Amphenol Thermometrics, Inc., Saint Marys, PA (US)

( * ) Notice: Subject to any disclaimer, the term of this patent is extended or adjusted under 35 U.S.C. 154(b) by 130 days.

(21) Appl. No.: 13/182,609

(22) Filed: Jul. 14, 2011

(65) Prior Publication Data

US 2013/0015176 A1 Jan. 17, 2013

(51) Int. Cl.
*H05B 1/02* (2006.01)

(52) U.S. Cl.
USPC ..... 219/494; 219/505; 219/538; 219/541; 219/550; 338/22 R

(58) Field of Classification Search
CPC ..... H05B 1/02
USPC ..... 219/494, 504, 505, 538, 541, 544, 588, 219/539; 338/22 R, 22 SD
See application file for complete search history.

(56) References Cited

U.S. PATENT DOCUMENTS 5,223,767 A 6/1993 Kulka
5,592,647 A * 1/1997 Yamauchi et al. ..... 392/432
5,751,138 A 5/1998 Venkata et al.
5,831,251 A * 11/1998 Oya et al. ..... 219/504
6,157,286 A * 12/2000 Ranjan et al. ..... 337/35
6,707,987 B2 * 3/2004 Zimmer ..... 392/397
6,720,536 B2 * 4/2004 Bohlender ..... 219/504
7,119,655 B2 * 10/2006 Starling et al. ..... 338/22 R
7,282,678 B2 * 10/2007 Tung et al. ..... 219/520
7,335,855 B2 * 2/2008 von der Luhe et al. ..... 219/201
7,711,332 B2 5/2010 Murdoch
7,777,161 B2 * 8/2010 Zeyen et al. ..... 219/520
7,884,503 B2 * 2/2011 Seidler et al. ..... 307/105
8,212,647 B2 * 7/2012 Feuerstein ..... 338/22 R
2008/0309168 A1 12/2008 Seidler et al.
2010/0052432 A1 3/2010 Seidler et al.

* cited by examiner

*Primary Examiner* — Mark Paschall
(74) *Attorney, Agent, or Firm* — Blank Rome LLP

(57) ABSTRACT

A heater includes at least one heating element having a resistance that varies non-linearly with respect to a temperature of the heating element. The heating element includes a first surface, a second surface opposite the first surface, a third surface extending between the first and second surfaces, and a fourth surface extending between the first and second surfaces, opposite the third surface. The heating element has a height defined between the first and second surfaces, and a width defined between the third and fourth surfaces, and wherein the width is less than the height. The heater also includes at least one electrode coupled to the first surface and configured to generate an electric field across the heating element and cause a current to flow through the heating element.

18 Claims, 4 Drawing Sheets

HEATING SYSTEM, HEATER, AND METHODS OF HEATING A COMPONENT

BACKGROUND OF THE INVENTION

The present application relates generally to heating systems and, more particularly, to a heating system, a heater, and methods of heating a component.

In at least some aircraft power systems, a plurality of sensors detect operating and/or environmental conditions within, or proximate to, the aircraft. Data received from the sensors may be integral to maintaining a desired operation of the aircraft. However, during some flight conditions and/or during operation in cold weather, ice may form on the sensors, or in close proximity to the sensors. Such ice may interfere with the operation of the sensor and/or may cause the data received from the sensors to be inaccurate.

To reduce or prevent ice formation around or on the sensors, at least some known aircraft include a heating system that heats the sensors. Some known heating systems transmit electricity through a plurality of electrodes coupled to a plurality of heating elements. An electric field is applied by the electrodes and causes a current to flow through the heating elements. The resistance of the heating elements causes heat to be transferred to the sensors or to structures associated with the sensors. However, such heating systems may induce harmonic currents to a supply current. Such harmonic currents may degrade a performance of an aircraft electrical system.

BRIEF DESCRIPTION OF THE INVENTION

In one embodiment, a heater is provided that includes at least one heating element having a resistance that varies non-linearly with respect to a temperature of the heating element. The heating element includes a first surface, a second surface opposite the first surface, a third surface extending between the first and second surfaces, and a fourth surface extending between the first and second surfaces, opposite the third surface. The heating element has a height defined between the first and second surfaces, and a width defined between the third and fourth surfaces, and wherein the width is less than the height. The heater also includes at least one electrode coupled to the first surface and configured to generate an electric field across the heating element and cause a current to flow through the heating element.

In another embodiment, a heating system is provided that includes a heater. The heater includes at least one heating element having a resistance that varies non-linearly with respect to a temperature of the heating element. The heating element includes a first surface, a second surface opposite the first surface, a third surface extending between the first and second surfaces, and a fourth surface extending between the first and second surfaces, opposite the third surface. The heating element has a height defined between the first and second surfaces, and a width defined between the third and fourth surfaces, and wherein the width is less than the height. The heater also includes at least one electrode coupled to the first surface and configured to generate an electric field across the heating element and cause a current to flow through the heating element.

In yet another embodiment, a method of heating a component of a machine is provided that includes positioning a heater in close proximity to the component. The heater includes at least one heating element including a first surface and a second surface opposite the first surface, a first electrode coupled to the first surface of the at least one heating element, and a second electrode coupled to the second surface. The method also includes applying an electric field between the first electrode and the second electrode such that a current flows through the at least one heating element to generate heat from the at least one heating element.

DETAILED DESCRIPTION OF THE INVENTION

In embodiments described herein, a heating system facilitates reducing an amplitude of harmonic currents generated by an electric field. Electrodes are placed on opposing surfaces of heating elements such that the electrodes are separated by the full height of each element. Because the height of each heating element is larger than the width of each heating element, an increased height of heating element material is present between electrodes as compared to prior art systems. As the strength of the electric field is inversely proportional to the spacing of electrodes, having a greater height of heating element material between electrodes decreases the strength of the electric field. Because the amplitude of harmonic currents induced is related to the strength of the electric field, the reduction in electric field strength causes a reduction of harmonic current amplitudes induced to a supply current flowing through the electrodes.

Figure 1:
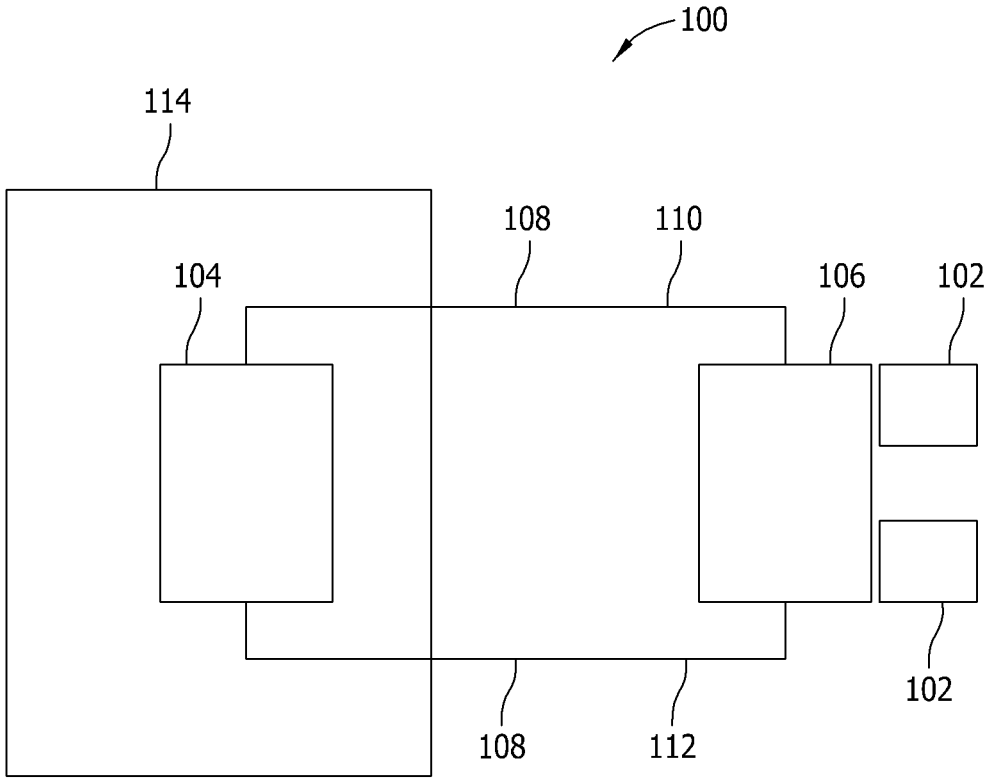
FIG. 1 is a block diagram of an exemplary heating system for use in heating at least one component.

FIG. 1 is a block diagram of an exemplary heating system 100 for use in heating at least one component 102 of a system or a machine (not shown). More specifically, in the exemplary embodiment, heating system 100 heats a plurality of sensors 102 used with an aircraft (not shown).

In the exemplary embodiment, heating system 100 includes an electric power source 104 and a heater 106 that is coupled to power source 104 via at least one conductor 108. More specifically, in the exemplary embodiment, power source 104 is coupled to heater 106 via a first conductor 110 and a second conductor 112. Alternatively, power source 104 may be coupled to heater 106 using any number of conductors 108 that enables heating system 100 to function as described herein. In one embodiment, a plurality of power sources 104 and/or a plurality of heaters 106 may be used with heating system 100. In the exemplary embodiment, power source 104 is part of an aircraft power system 114 and supplies alternating current (AC) power (i.e., AC voltage and current) to heater 106 via first and/or second conductors 110 and 112, respectively. Heater 106, in the exemplary embodiment, is coupled to, or is positioned in close proximity to, sensors 102 such that heat from heater 106 is at least partially transferred to sensors 102.

During operation, power source 104 supplies an AC voltage and current to heater 106 via first and/or second conductors 110 and/or 112. The AC voltage creates an electric current within at least one element (not shown in FIG. 1) of heater 106, as described more fully below. The electric current generates heat within the elements of heater 106, and at least a portion of the heat is transferred from heater 106 to sensors 102. As such, an undesirable formation of ice on, or proximate to, sensors 102 is facilitated to be eliminated and/or prevented.

Figure 2:
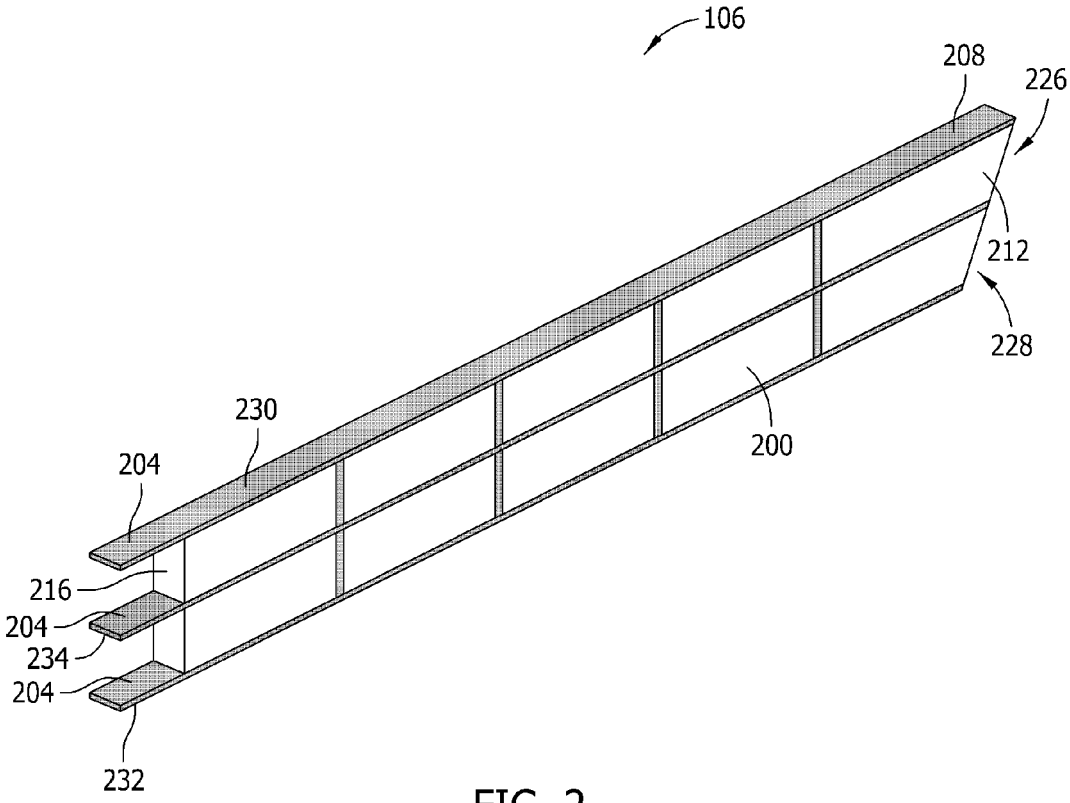
FIG. 2 is a perspective view of an exemplary heater that may be used with the heating system shown in FIG. 1.
Figure 3:
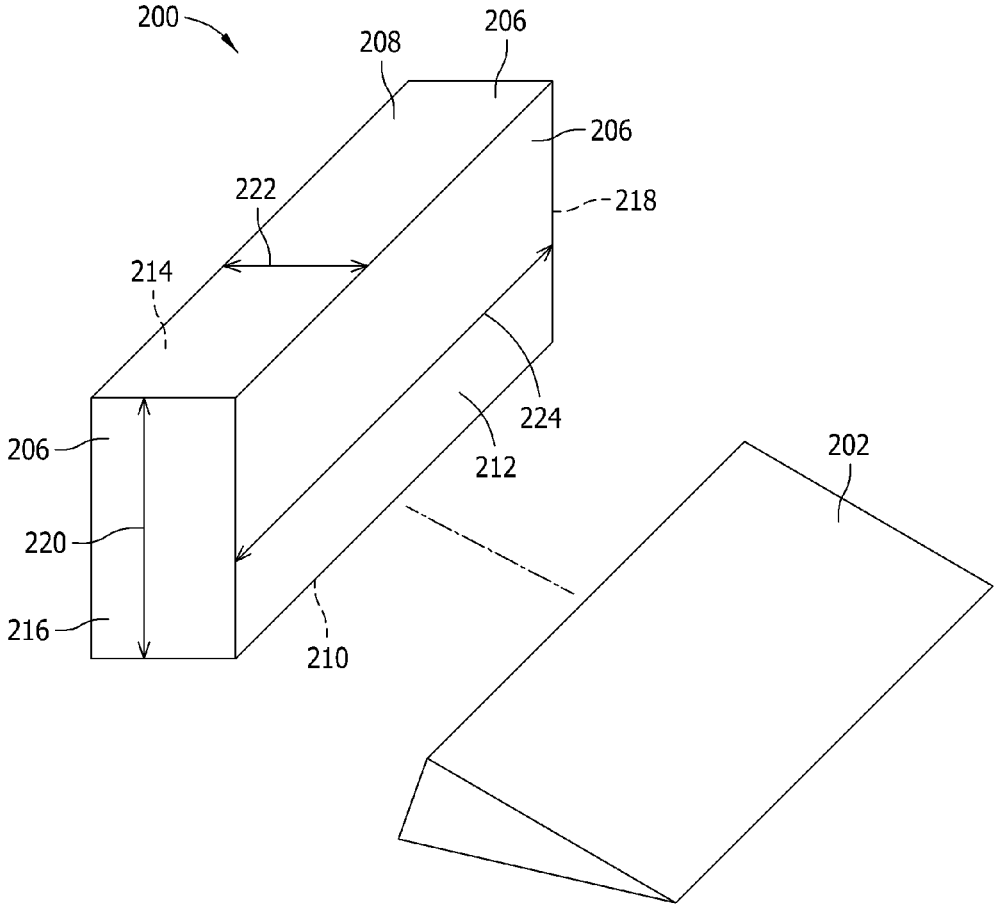
FIG. 3 is a perspective view of an exemplary heating element and an exemplary vane that may be used with the heater shown in FIG. 2.

FIG. 2 is a perspective view of an exemplary heater 106 that may be used with heating system 100 (shown in FIG. 1). FIG. 3 is a perspective view of an exemplary heating element 200 and an exemplary vane 202 that may be used with heater 106. In the exemplary embodiment, heater 106 includes a plurality of heating elements 200 that are coupled to, or positioned in close proximity to, a plurality of electrodes 204. Alternatively, heater 106 may include a single heating element 200 and/or a single electrode 204. In the exemplary embodiment, electrodes 204 are each electrically coupled to power source 104 via first and second conductors 110 and 112, respectively (shown in FIG. 1).

In the exemplary embodiment, each heating element 200 is manufactured from a material, such as doped semiconducting barium titanate, that has a resistance that varies non-linearly with respect to a temperature of the material and/or heating element 200. As such, in the exemplary embodiment, heater 106 is a self-regulating heater 106 that decreases a generation of heat as the temperature of heater 106 increases, and that increases a generation of heat as the temperature of heater 106 decreases. More specifically, as the temperature of heating elements 200 increases, the resistance of heating elements 200 increases. Accordingly, a current flowing through heating elements 200 is decreased and consequently, an amount of heat generated by heating elements 200 is decreased. Conversely, as the temperature of heating elements 200 decreases, the resistance of heating elements 200 decreases. Accordingly, the current flowing through heating elements 200 is increased and consequently, the amount of heat generated by heating elements 200 is increased.

In the exemplary embodiment, heating elements 200 are substantially identical and each has a substantially rectangular cross-sectional shape that includes a plurality of substantially rectangular outer surfaces 206. Alternatively, heating elements 200 may have any cross-sectional shape that enables heater 106 to function as described herein. In the exemplary embodiment, surfaces 206 include a first or upper surface 208, an opposing second or lower surface 210, a third or outer surface 212, an opposing fourth or inner surface 214, a fifth or front surface 216, and an opposing sixth or rear surface 218. Surfaces 212 and 214 extend between upper and lower surfaces 208 and 210, respectively. Surfaces 216 and 218 extend between upper and lower surfaces 208 and 210, respectively, and between outer and inner surfaces 212 and 214, respectively. Moreover, in the exemplary embodiment, a height 220 (or thickness) of each heating element 200 is defined between upper surface 208 and lower surface 210, and a width 222 of each heating element 200 is defined between outer surface 212 and inner surface 214. In the exemplary embodiment, height 220 is greater than width 222. Moreover, a length 224 of each heating element 200 is measured between front surface 216 and rear surface 218.

Heating elements 200, in the exemplary embodiment, are clustered together in a group of upper heating elements 226 and in a group of lower heating elements 228. An upper electrode 230 is coupled to an upper surface 208 of each upper heating element 226 such that electrode 230 extends along substantially a full length 224 of each upper heating element 226. In the exemplary embodiment, a lower electrode 232 is coupled to the lower surface 210 of each lower heating element 228 such that electrode 232 extends along substantially a full length 224 of each lower heating element 228. Moreover, in the exemplary embodiment, a center electrode 234 is coupled between upper and lower heating elements 226 and 228, respectively. More specifically, center electrode 234 is coupled to the lower surface 210 of each upper heating element 226 and to the upper surface 208 of each lower heating element 228. Center electrode 234 extends along a substantially full length 224 of each upper heating element 226 and of each lower heating element 228. In the exemplary embodiment, center electrode 234 is coupled to first conductor 110, and upper and lower electrodes 230 and 232 are each coupled to second conductor 112. Alternatively, heating elements 200 and/or electrodes 204 may be positioned in any other configuration that enables heater 106 to function as described herein.

Heater 106 includes at least one vane 202 that extends from at least one upper heating element 226 and/or from at least one lower heating element 228. More specifically, in the exemplary embodiment, vane 202 is coupled to a plurality of heating elements 226 and/or heating elements 228 via a resin. Alternatively, one or more vanes 202 may be coupled to heating elements 226 and/or 228 using any suitable adhesive or any other coupling mechanism that enables heater 106 to function as described herein. In the exemplary embodiment, vane 202 facilitates transferring heat from heating elements 200 to sensors 102. More specifically, in the exemplary embodiment, vane 202 (or a plurality of vanes 202) is coupled to elements 226 and to elements 228 along outer surface 212 and/or inner surface 214 such that vane 202 extends substantially along a full length 224 of each heating element 226 and 228 and/or such that heat is transferred to vane 202 along substantially a full length of vane 202. In the exemplary embodiment, vanes 202 are fabricated from a metal material or a metal alloy that enables heat generated by heater 106 to be transferred to sensors 102 and/or to one or more structures associated with sensors 102. Alternatively, vanes 202 may be fabricated from a ceramic material and/or any other suitable material that enables heater 106 to function as described herein.

During operation, in the exemplary embodiment, center electrode 234 receives AC voltage from power source 104. As the voltage is applied to center electrode 234, an electric field (not shown) is generated. The electric field is applied across upper and lower heating elements 226 and 228, respectively (i.e., between center electrode 234 and upper electrode 230, and between center electrode 234 and lower electrode 232). As the electric field is applied across upper and lower heating elements 226 and 228, a current flows through elements 226 and 228, respectively. The current is received by electrodes 230 and 232 and is transmitted from electrodes 230 and 232 to power source 104 via second conductor 112.

Moreover, in the exemplary embodiment, as the current flows through heating elements 226 and 228, the resistance of heating elements 226 and 228 causes heat to be generated within heating elements 226 and 228. At least a portion of the generated heat is transferred from outer surfaces 212, inner surfaces 214, and/or vanes 202 towards sensors 102. In the exemplary embodiment, sensors 102 increase in temperature and/or resist a decrease in temperature due to the transferred heat energy such that the formation of ice on, or in close proximity to, sensors 102 is facilitated to be eliminated or prevented.

The electric field applied across upper and lower heating elements 226 and/or 228 may cause at least one harmonic current to be induced to a current flowing through upper electrode 230 and/or lower electrode 232. The harmonic current may undesirably generate heat and/or degrade a quality of power within power source 104 and/or aircraft power system 114 (shown in FIG. 1).

As described herein, heater 106 and/or heating system 100 facilitates reducing an amplitude of harmonic currents generated by the electric field. More specifically, electrodes 204 are placed on opposing surfaces 206 (i.e., upper surface 208 and lower surface 210) of heating elements 200 such that electrodes 204 are separated by the full height 220 (or thickness) of each element 200. More specifically, because the height 220 of each heating element 200 is larger than the width 222 of each element 200, an increased height 220 of heating element material is present between electrodes 204 as compared to prior art systems. Because the strength of the electric field is inversely proportional to the spacing of electrodes 204, having a greater height 220 of heating elements 200 between electrodes 204 decreases the strength of the electric field. Because the amplitude of harmonic currents induced to electrodes 204 is related to the strength of the electric field applied across heating elements 200, the reduction in electric field strength causes a reduction of harmonic current amplitudes induced to the supply current flowing through electrodes 204.

The increase in heating material height 220 between electrodes 204 increases an effective electrical resistance of each heating element 200 with respect to the current transmitted through heating elements 200. To maintain a similar amount of current transmitted through heating elements 200 as compared to prior art systems (and thus maintain a similar amount of heat energy produced by heater 106), the resistivity of the heating element material can be reduced. For example, the doping or processing conditions of the semiconducting barium titanate material may be modified to reduce the resistivity of the material. The reduced resistivity substantially offsets the increased resistance of the material due to the increased height 220 of heating elements 200. Accordingly, heater 106 generates a substantially similar amount of heat using a reduced electric field strength as compared to prior art systems, thus reducing the generation and/or amplitude of harmonic currents within electrodes 204.

In an alternative embodiment, upper electrode 230 is coupled to first conductor 110 and receives AC voltage from power source 104. Lower electrode 232 is coupled to second conductor 112. Center electrode 234 is not coupled to first conductor 110 or to second conductor 112 (i.e., center electrode 234 is "floating"). Alternatively, heater 106 does not include center electrode 234, and in such an embodiment, an electric field is generated by a voltage applied to upper electrode 230. Moreover, in the alternative embodiment, the electric field is generated across upper and lower heating elements 226 and 228, and a current flows through upper and lower heating elements 226 and 228 that is then transmitted back to power source 104 via second conductor 112. Furthermore, in such an embodiment, the current flows through additional heating element material, thus generating more heat as compared to other embodiments described herein. As such, the electric field may be reduced in strength within heating elements 200 and the amplitude of the resulting harmonic currents may be likewise reduced.

Figure 4:
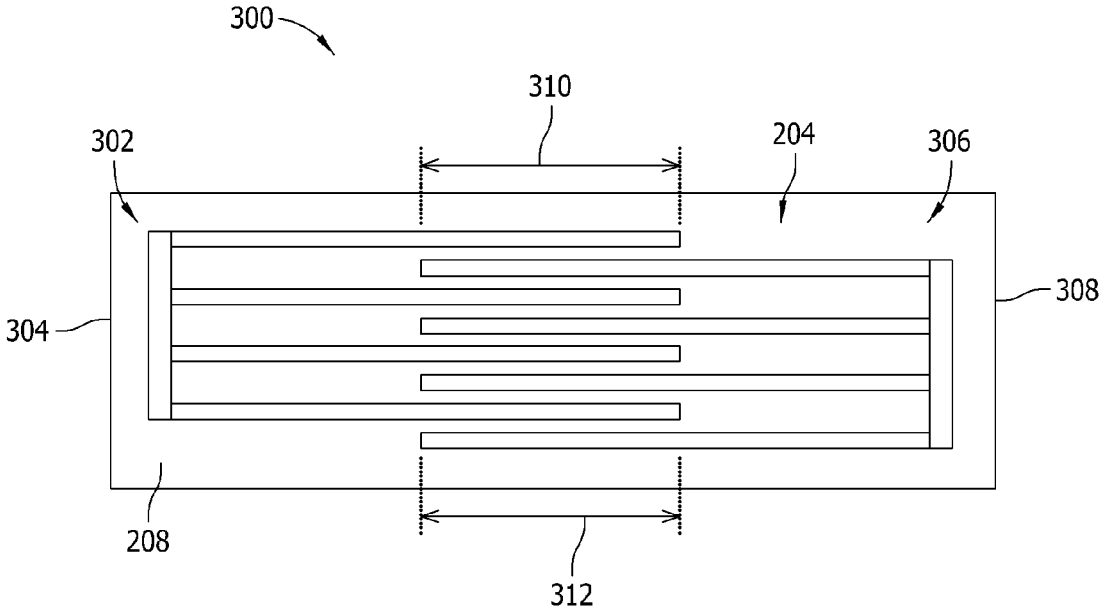
FIG. 4 is a top view of an exemplary heating element that may be used with the heater shown in FIG. 2.

FIG. 4 is a top view of an exemplary heating element 300 that may be used with heating system 100 (shown in FIG. 1) and/or heater 106 (shown in FIG. 2). In the exemplary embodiment, unless otherwise specified, heating element 300 is similar to heating element 200 (shown in FIG. 2), and similar components are identified in FIG. 4 with the same reference numerals used in FIG. 2.

In the exemplary embodiment, heating element 300 includes a plurality of electrodes 204 (i.e., upper electrodes 230) that are coupled to upper surface 208. A first electrode group 302 extends from a first side 304 of upper surface 208 and a second electrode group 306 extends towards first electrode group 302 from an opposing second side 308 of upper surface 208. In the exemplary embodiment, an end portion 310 of each electrode 204 within first electrode group 302 interleaves an end portion 312 of each electrode 204 within second electrode group 306. Alternatively, any other amount of each electrode 204, such as substantially the entire length, within first electrode group 302 may interleave each electrode 204 within second electrode group 306.

During operation, in the exemplary embodiment, power source 104 supplies AC voltage and current to first electrode group 302, and second electrode group 306 via first conductor 110 and/or any other conductor 108 (both shown in FIG. 2) such that a voltage differential is created between the electrode groups 302 and 306. An electric field generated between adjacent electrodes 204 causes a current to flow through heating element 300 to center electrode 234 and/or to lower electrode 232. As the current flows through heating element 300, heat generated is transferred to sensors 102 via vanes 202, as described more fully above.

In one embodiment, a method of heating a component of a machine, such as a sensor of an aircraft, includes positioning a heater in close proximity to the component. The heater includes at least one heating element including a first surface and a second surface opposite the first surface, a first electrode coupled to the first surface of the at least one heating element, and a second electrode coupled to the second surface. The method also includes applying an electric field between the first electrode and the second electrode such that a current flows through the at least one heating element to generate heat from the at least one heating element.

In another embodiment, the heater includes an upper heating element and a lower heating element. In such an embodiment, the method includes applying an electric field between the upper heating element and the lower heating element such that a current flows through the upper heating element and the lower heating element.

In another embodiment, the method includes varying a resistance of the heating element non-linearly with respect to a temperature of the heating element. For example, the resistance is varied by fabricating the heating element from barium titanate and adjusting a current flowing through the heating element.

In yet another embodiment, at least one vane is coupled to a heating element. In such an embodiment, the method includes transferring heat from the vane to the component.

As described herein, a heating system is provided that includes a robust and efficient heater that facilitates preventing the formation of ice on, or in close proximity to, at least one sensor. The heater includes a plurality of electrodes that are coupled to an upper surface and to a lower surface of each heating element within the heater. An AC voltage is applied to a center electrode and generates an electric field that is applied across the heating elements such that a current flows through the heating elements. Heat generated by the application of the electric field is transferred from the heating elements to the sensors via at least one vane. Because the thickness of the heating elements is increased as compared to prior art heating systems, the current flows through an increased amount of heating element material as compared to prior art heating systems. Accordingly, an increased amount of heat is generated by the heating elements and a lower strength electric field may be used to obtain a similar amount of heat as compared to prior art heating system. Because a lower strength electric field is applied across the heating elements, an amplitude of harmonic currents generated is facilitated to be reduced as compared to the amplitude of harmonic currents generated within prior art systems.

Exemplary embodiments of a heating system, a heater, and methods of heating a component are described above in detail. The heating system, heater, and methods are not limited to the specific embodiments described herein, but rather, components of the system and/or heater and/or steps of the methods may be utilized independently and separately from other components and/or steps described herein. For example, the heater may also be used in combination with other power systems and machines, and is not limited to practice with only the aircraft heating system as described herein. Rather, the exemplary embodiment can be implemented and utilized in connection with many other heating or power applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A heater comprising:

at least one heating element having a resistance that varies non-linearly with respect to a temperature of the at least one heating element, the at least one heating element comprises:

a first surface;

a second surface opposite the first surface, the at least one heating element having a height defined between the first and second surfaces;

a third surface extending between the first and second surfaces; and a fourth surface extending between the first and second surfaces, the fourth surface is opposite the third surface, a width of the at least one heating element is defined between the third surface and the fourth surface and is shorter than the height of the at least one heating element;

at least one electrode, wherein the at least one electrode comprises a first electrode coupled to the first surface and a second electrode coupled to the second surface, and wherein the first electrode and the second electrode are configured to generate an electric field across the at least one heating element and cause a current to flow through the at least one heating element.

2. The heater in accordance with claim 1, wherein the at least one heating element comprises at least one upper heating element and at least one lower heating element, the second electrode is coupled to the second surface of the at least one upper heating element and to the first surface of the at least one lower heating element.

3. The heater in accordance with claim 2, wherein the at least one electrode further comprises a third electrode coupled to the second surface of the at least one lower heating element.

4. The heater in accordance with claim 1, further comprising at least one vane coupled to at least one of the third surface and the fourth surface, the at least one vane configured to transfer heat generated within the at least one heating element to at least one component of a machine.

5. The heater in accordance with claim 1, wherein the at least one heating element comprises a fifth surface and an opposing sixth surface, the at least one heating element having a length defined between the fifth and sixth surfaces.

6. The heater in accordance with claim 5, wherein the at least one electrode extends along the full length of the at least one heating element.

7. The heater in accordance with claim 1, wherein the at least one electrode comprises a first plurality of electrodes and a second plurality of electrodes coupled to the first surface, wherein at least a portion of each electrode of the first plurality of electrodes interleaves at least a portion of each electrode of the second plurality of electrodes.

8. A heating system comprising:

a heater comprising:

at least one heating element having a resistance that varies non-linearly with respect to a temperature of the at least one heating element, the at least one heating element comprises:

a first surface;

a second surface opposite the first surface, the at least one heating element having a height defined between the first and second surfaces;

a third surface extending between the first and second surfaces; and a fourth surface extending between the first and second surfaces, the fourth surface is opposite the third surface, a width of the at least one heating element is defined between the third surface and the fourth surface and is shorter than the height of the at least one heating element; and at least one electrode, wherein the at least one electrode comprises a first electrode coupled to the first surface and a second electrode coupled to the second surface, and wherein the first electrode and the second electrode are configured to generate an electric field across the at least one heating element and cause a current to flow through the at least one heating element; and a power source coupled to the heater, the power source configured to supply alternating current (AC) voltage to the at least one electrode.

9. The heating system in accordance with claim 8, wherein the at least one heating element comprises at least one upper heating element and at least one lower heating element, the second electrode is coupled to the second surface of the at least one upper heating element and to the first surface of the at least one lower heating element.

10. The heating system in accordance with claim 9, wherein the at least one electrode further comprises a third electrode coupled to the second surface of the at least one lower heating element.

11. The heating system in accordance with claim 8, further comprising at least one vane coupled to at least one of the third surface and the fourth surface, the at least one vane configured to transfer heat generated within the at least one heating element to at least one component of a machine.

12. The heating system in accordance with claim 8, wherein the at least one heating element comprises a fifth surface and an opposing sixth surface, the at least one heating element having a length defined between the fifth and sixth surfaces.

13. The heating system in accordance with claim 12, wherein the at least one electrode extends along the full length of the at least one heating element.

14. The heating system in accordance with claim 8, wherein the at least one electrode comprises a first plurality of electrodes and a second plurality of electrodes coupled to the first surface, wherein at least a portion of each electrode of the first plurality of electrodes interleaves at least a portion of each electrode of the second plurality of electrodes.

15. A method of heating a component, the method comprising:

positioning a heater in close proximity to the component, wherein the heater includes:

at least one heating element including a first surface and a second surface opposite the first surface;

a first electrode coupled to the first surface; and a second electrode coupled to the second surface; and applying an electric field between the first electrode and the second electrode such that a current flows through the at least one heating element to generate heat from the at least one heating element.

16. The method in accordance with claim 15, wherein the at least one heating element includes an upper heating element and a lower heating element, the method further comprises applying an electric field between the upper heating element and the lower heating element such that a current flows through the upper heating element and the lower heating element.

17. The method in accordance with claim 15, further comprising varying a resistance of the at least one heating element non-linearly with respect to a temperature of the at least one heating element.

18. The method in accordance with claim 15, wherein at least one vane is coupled to the at least one heating element, the method further comprising transferring heat from the at least one vane to the component.

* * * * *